US005335399A

United States Patent [19]

Chou

[11] Patent Number: 5,335,399

[45] Date of Patent: Aug. 9, 1994

[54] CLIP

[76] Inventor: Kuo H. Chou, Suite 1, 11F, 95-8 Chang Ping Road, Sec. 1, Taichung, Taiwan

[21] Appl. No.: 867,375

[22] Filed: Apr. 13, 1992

[51] Int. Cl.[5] ..... B42F 1/00

[52] U.S. Cl. ..... 24/67.7; 24/67 R

[58] Field of Search ..... 24/67.7, 67.3, 67.5, 24/67 R, 546, 545

[56] References Cited

U.S. PATENT DOCUMENTS

| | | | |
|---|---|---|---|
| 3,597,813 | 8/1971 | Takahashi | 24/67.5 |
| 3,833,970 | 9/1974 | Smith, Jr. | 24/67.7 |
| 4,228,569 | 10/1980 | Snyder | 24/67.3 |
| 5,058,242 | 10/1991 | Liu et al. | 24/67.7 |
| 5,079,808 | 1/1992 | Brown | 24/67.7 |

*Primary Examiner*—Victor N. Sakran

[57] ABSTRACT

A clip comprised of two pivoted clamping plates with a V-shaped plate spring supported thereinbetween, wherein said two pivoted clamping plates are each comprised of a heart-shaped knob at one end and a heart-shaped clamping portion longitudinally aligned, said knob having an elongated retaining hole, said clamping portion having a first vertical side wall and a second vertical side wall at two opposite sides, a rectangular pressure board curving inwards between said first and second vertical side walls, and a clamping end spaced from said knob, said clamping end having a series of rectangular teeth, said rectangular pressure board having a projecting strip obliquely projecting upwards and outwards, said first vertical side wall having an eye end, said second vertical side wall having a stubbed tube, the stubbed tube on one clamping plate being inserted into the eye end on the other clamping plate; said V-shaped plate spring comprised of two opposite spring boards extending from a corrugated connecting portion, said spring boards each having a projecting strip inserted into said elongated retaining hole and an elongated retaining hole into which the projecting strip of said rectangular pressure board is inserted.

4 Claims, 6 Drawing Sheets

CLIP

BACKGROUND OF THE INVENTION

The present invention relates to clips and more particularly to such a clip which can conveniently and rapidly be assembled, and is suitable for mass production.

Several clips have been known for use in holding objects together. FIG. 1 illustrates a clip according to the prior art which is generally comprised of two symmetrical clamping plates (1), (2) secured by a pin (4), and a torsional spring (3) sleeved on the pin (4) with its two opposite ends (10), (11) respectively stopped against the clamping plates (1), (2). The clamping plates (1), (2) each have a knob (4) or (5) for pressing the hand, two vertical side walls (6), (7) at two opposite sides, and a curved clamping end (12) or (13), wherein each vertical side wall (6) or (7) has a pin hole (8) or (9) aligned with each other for fastening the pin (4). This structure of clip is not easy to assemble because the outward spring force of the torsional spring (3) tends to push the two clamping plates (1), (2) apart from each other during the insertion of the pin (4) and, the two opposite ends of the pin (4) must be hammered into heads or clinched, to lock them into place. Further, this structure of clip is not as practical in use because the two opposite ends (10), (11) of the torsional spring (3) are respectively stopped against the two clamping plates (1), (2) at offset locations causing the clamping ends (12), (13) to bear a torsional force, and therefore, a stable clamping effect is not easy to achieve.

SUMMARY OF THE INVENTION

The present invention has been accomplished to eliminate the aforesaid disadvantages. It is therefore the main object of the present invention to provide a clip which is easy to assemble and produces a uniform clamping force. To achieve this object, there is provided a clip generally comprised of two pivoted clamping plates with a V-shaped plate spring supported thereinbetween. The two pivoted clamping plates are each comprised of a heart-shaped knob at one end and a heart-shaped clamping portion longitudinally aligned. The heart-shaped knob has a hole for hanging on a support, and an elongated retaining hole for fastening the V-shaped plate spring, the clamping portion is comprised of a clamping end at one end, which has a series of rectangular teeth for clamping, a first vertical side wall and a second vertical side wall at two opposite sides, a rectangular pressure board curving inwards between the first and second vertical side walls. The rectangular pressure board has a projecting strip obliquely projecting upwards and outwards. The first vertical side wall has an eye end while the second vertical side wall has a stubbed tube. By inserting the stubbed tube on one clamping plate into the eye end on the other clamping plate, the two clamping plates are connected together. The V-shaped plate spring is comprised of two opposite spring boards extending from a corrugated connecting portion. The spring boards each have a projecting strip inserted into the elongated retaining hole on either clamping plate, and an elongated retaining hole into which the projecting strip on the rectangular pressure board of either clamping plate is inserted.

DETAILED DESCRIPTION OF THE PREFERRED EMBODIMENTS

Figure 1:
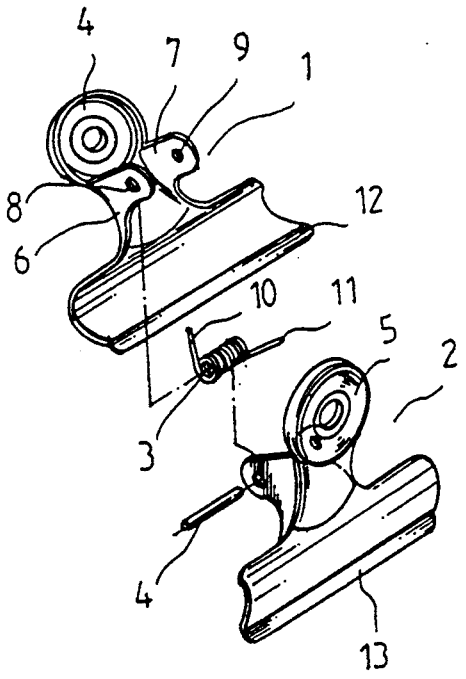
FIG. 1 is an exploded perspective view of a clip according to the prior art.
Figure 2:
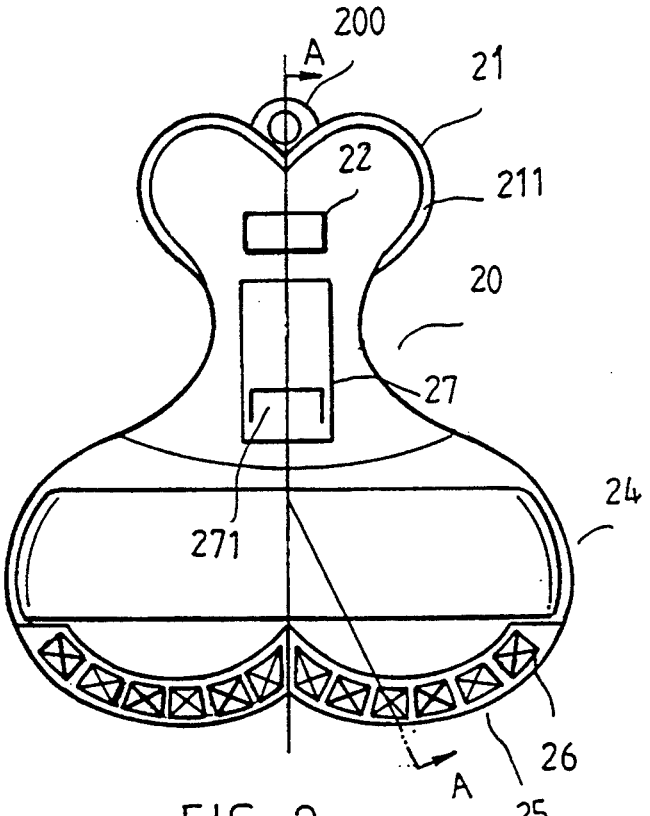
FIG. 2 is an orthographic view of the first embodiment of the present invention.
Figure 4:
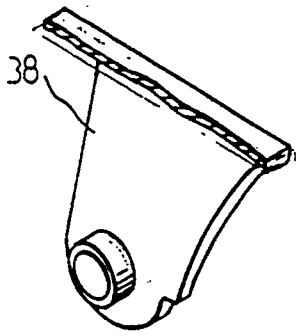
FIG. 4 is a perspective view of the right upright wall on each clamping plate of the first embodiment of the present invention.
Figure 3:
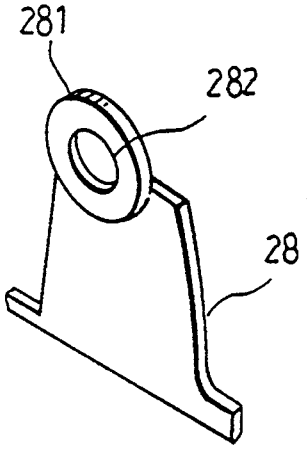
FIG. 3 is a perspective view of the left upright wall on each clamping plate of the first embodiment of the present invention.

Referring to FIG. 2, a clip is generally comprised of two opposed clamping plates 20, 30 and a substantially V-shaped plate spring 50 fastened therebetween. Each clamping plate 20 or 30 comprises a heart-shaped knob 21 or 31 at one end, and a heart-shaped clamping portion 24 at an opposite end. The knob 21 or 31 has an eye end 200 or 300 for hanging and a peripheral flange 211 or 311 at right angle for comfortable and safe operation. The clamping portion 24 is relatively bigger than the knob 21 or 31 and disposed in a reverse direction with a middle part thereof curving outwards. The clamping portion 24 has a flat clamping end 25 (see FIG. 5) with a series of rectangular teeth 26 thereon for positive clamping. The rectangular teeth 26 have end surfaces alternatively curving outwards and inwards for positive clamping. The two clamping plates 20, 30 are each comprise of two upright walls at the middle, namely, the left upright wall 28 and the right upright walls 38 (the upright walls on the other side are not shown). Referring to FIGS. 3 and 4, the left upright wall 28 is made of a flat structure having an eye end 281 with a hole 282 in the center. The right upright wall 38 is made of a flat structure having a hole 382 in a location corresponding to the eye end 281 on the left upright wall 28 and a stubbed tube 383 rising from and around hole 382. The four upright walls 28, 28', 38, 38' of the two clamping plates 20, 30 (see FIG. 6) are symmetrical, namely, the upright walls 28, 28' of the left clamping plate 20 have an eye end 281 and a stubbed tube 284 for fastening stubbed tube 382 and eye end 384 on the right clamping plate 30 respectively.

Figure 8:
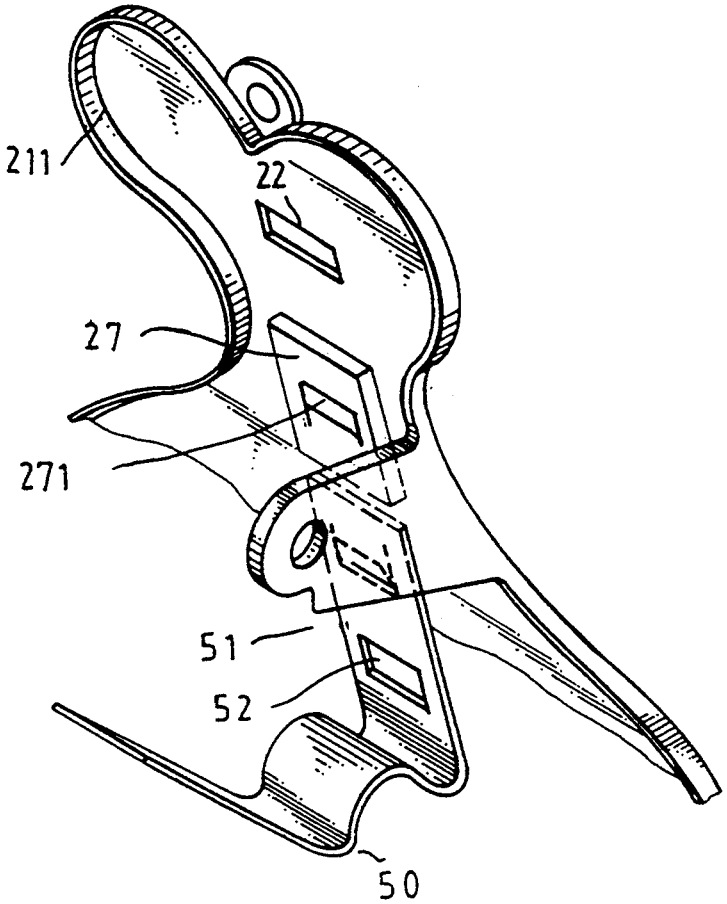
FIG. 8 is a perspective view of the V-shaped plate spring of the first embodiment of the present invention.

Referring to FIG. 8 the knob 21 or 31 of the clamping plate 20 or 30 has a rectangular hole 22 or 32 at the middle and a rectangular pressure board 27 or 37 below the rectangular hole 22 or 32. The rectangular pressure board 27 or 37 is relatively bigger than the rectangular hole 22 or 32 and is formed on the clamping plate 20 or 30 on the inner side through the process of punching.

The rectangular pressure board 27 or 37 has its opposite sides connected to the clamping plate 20 or 30 and its opposite ends opened. A projecting strip 271 is made on the rectangular pressure board 27 by punching a U-shaped opening on the rectangular pressure board 27.

Referring to FIG. 8, the plate spring 50 has two opposing spring boards extending from a corrugated bottom end. The width of the plate spring 50 is equal to the width of the rectangular pressure board 27 or 37. A projecting strip 51 and an opening 52 are made on each spring board of the plate spring 50 at opposite ends. The projecting strip 51 is made on each spring board of the plate spring 50 through the process of punching. However, the projecting direction of the projecting strip 51 is opposite to the projecting direction of the projecting strip 271.

Figure 5:
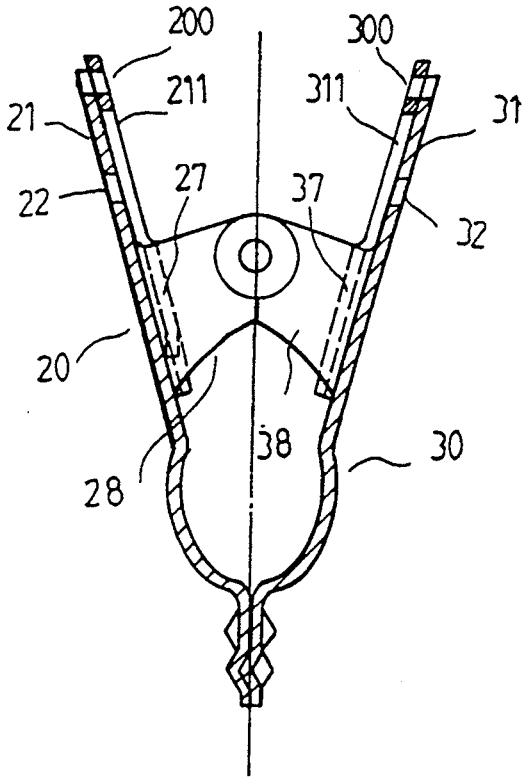
FIG. 5 is a cross section taken on line A—A of FIG. 2.
Figure 6:
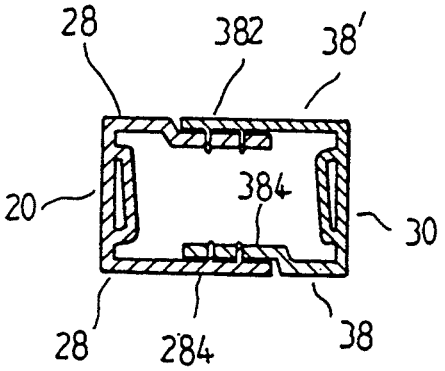
FIG. 6 is a cross section taken on line B—B of FIG. 5.
Figure 7:
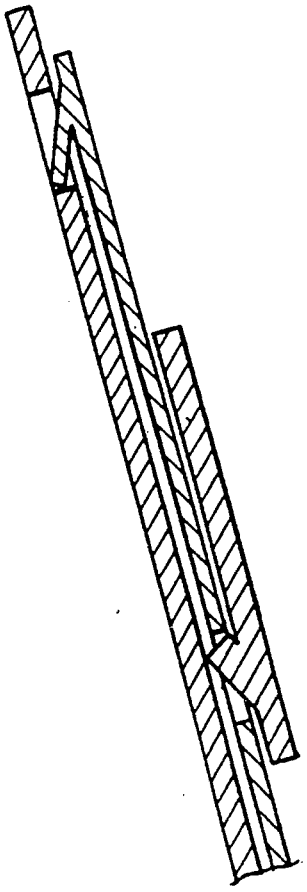
FIG. 7 is a sectional view of the V-shaped plate spring of the first embodiment of the present invention.
Figure 9:
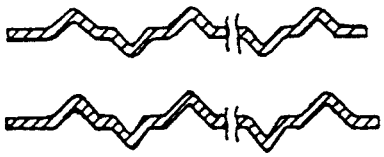
FIG. 9 is a plan view of the rectangular teeth on the clamping end of each clamping plate of the first embodiment of the present invention.

By inserting the stubbed tubes into the eye ends according to the assembly process shown in FIG. 5, the upright walls 28, 28', 38, 38' of the two clamping plates 20, 30 are respectively connected together. Then, the V-shaped plate spring 50 is inserted in between the two clamping plates 20, 30 through the clamping ends thereof. Because the projecting strips 271 of the rectangular pressure board 27, 37 are obliquely extending upwards and outwards, they do not obstruct the insertion of the V-shaped plate spring 50. After having been inserted to the level of the rectangular holes 22 of the two clamping plates 20, 30, the two opposite spring boards of the spring plate 50 spring outward automatically causing the projecting strips 51 to engage into the rectangular holes 22 on the two knobs 21, 31 of the two clamping plates 20, 30 respectively, and at the same time, the projecting strips 271 on the rectangular pressure boards 27 of the two clamping plates 20, 30 insert into the openings 52 on the two spring boards of the spring plate 50. Therefore, the V-shaped plate spring 50 is firmly secured to the rectangular pressure boards 27 of the two clamping plates 20, 30 (see FIG. 7).

Figure 10:
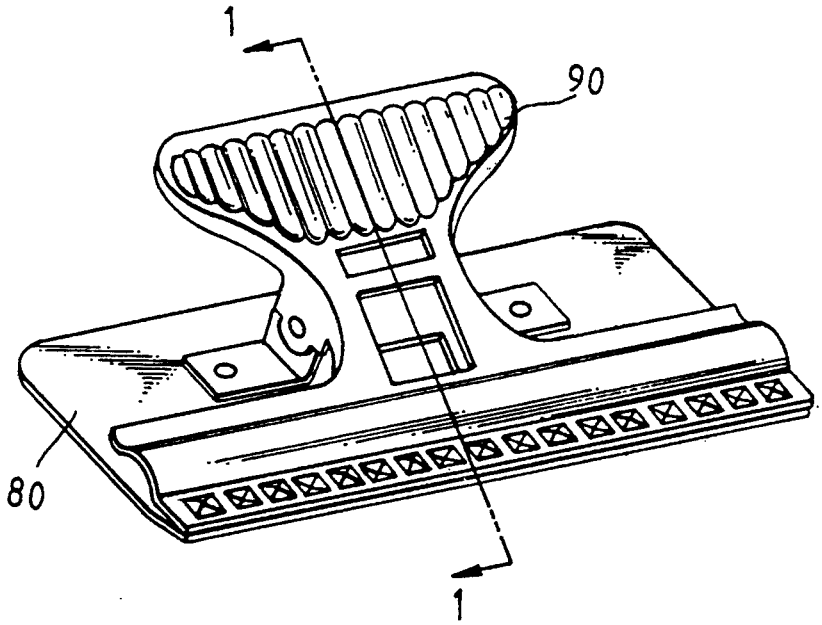
FIG. 10 is a perspective view of a second embodiment of the present invention.
Figure 11:
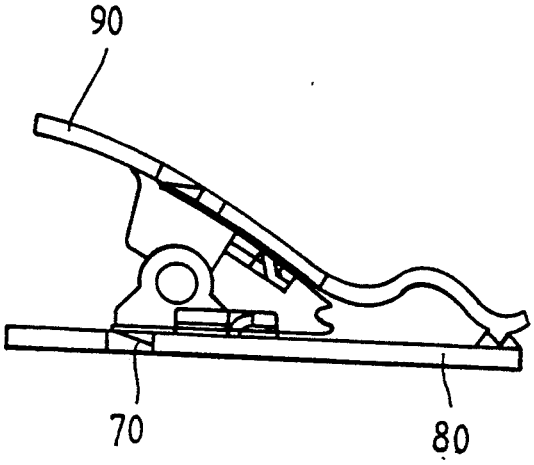
FIG. 11 is a side view of the second embodiment of the present invention.

Referring to FIG. 10, therein illustrated is an alternate form of the present invention. In this embodiment, only one clamping plate is used. As illustrated, the clip is comprised of a single clamping plate 90 pivoted to a flat base 80 and supported by a V-shaped spring plate 70. The principle of the structural design of this alternate form is similar to the foregoing first embodiment of the present invention. The flat base 80 has two conical teeth upstanding from the front, top edge thereof. The clamping plate 90 has embossed strips on the knob thereof for positive grip, and an extended flat clamping end with downward teeth for clamping sheets of paper on the teeth of the flat base 80 (see FIG. 11). This structure of clip can be fastened on a flat board for holding sheets of paper efficiently.

The two clamping parts can be assembled into a clip conveniently and rapidly, by means of inserting the stubbed tube into the eye end. The use of a V-shaped plate spring instead of the conventional spring coil, enables a stable and accurate clamping effect to be achieved. The heart-shaped design of the clamping plates in the foregoing first embodiment of the present invention increases the clamping area of a clip. Further, the arrangement of the conical teeth increases the clamping force of the clip.

I claim:

1. A clip comprised of two pivoted parts with a V-shaped plate spring means retained thereinbetween, and characterized in that;

said two pivoted parts are each comprised of a heart-shaped knob at one end and a heart-shaped clamping portion longitudinally aligned, said knob having an elongated retaining hole, said clamping portion having a first vertical side wall and a second vertical side wall at two opposite sides, a rectangular pressure board curving inwards between said first and second vertical side walls, and a clamping end spaced from said knob, said clamping end having a series of rectangular teeth, said rectangular pressure board having a projecting strip obliquely projecting upwards and outwards, said first vertical side wall having an eye end, said second vertical side wall having a stubbed tube, the stubbed tube on the second vertical side wall of one of said two pivoted parts being inserted into said eye end on the first vertical side wall of the other of said two pivoted parts;

said V-shaped plate spring comprised of two opposite spring boards extending from a corrugated connecting portion, said spring boards each having a projecting strip inserted into said elongated retaining hole and an elongated retaining hole into which the projecting strip of said rectangular pressure board is inserted.

2. The clip of claim 1, wherein said two pivoted parts each have a hole for hanging.

3. The clip of claim 1, wherein said rectangular teeth have end surfaces alternatively curving outwards and inwards.

4. The clip of claim 1, wherein said two pivoted parts include a flat base board, and a clamping plate pivoted to said flat base board.

* * * * *